US005244446A

United States Patent [19]

Engel et al.

[11] Patent Number: 5,244,446

[45] Date of Patent: Sep. 14, 1993

[54] MULTI-PURPOSE TORSO EXERCISE APPARATUS

[75] Inventors: Timothy S. Engel, Mound; Frank W. Campbell, Robbinsdale; Weston L. Cutter, Mendota Heights, all of Minn.

[73] Assignee: NordicTrack, Inc., Chaska, Minn.

[21] Appl. No.: 751,732

[22] Filed: Aug. 29, 1991

[51] Int. Cl.[5] ..... A63B 21/00

[52] U.S. Cl. ..... 482/137; 482/118; 482/119; 482/134

[58] Field of Search ..... 482/97, 99, 100, 115, 482/118, 119, 133, 134, 137, 142

[56] References Cited

U.S. PATENT DOCUMENTS

| | | | |
|---|---|---|---|
| 3,103,357 | 9/1963 | Berde | 482/118 |
| 3,107,951 | 10/1963 | Palm . | |
| 3,107,952 | 10/1963 | Palm . | |
| 3,107,953 | 10/1963 | Palm . | |
| 3,315,959 | 4/1967 | Carnielli | 482/118 X |
| 3,861,215 | 1/1975 | Bradley | 482/116 |
| 4,372,553 | 2/1983 | Hatfield . | |
| 4,500,089 | 2/1985 | Jones | 482/100 |
| 4,546,971 | 10/1985 | Baasoch | 482/100 |
| 4,566,693 | 1/1986 | Seidentop et al. . | |
| 4,621,807 | 11/1986 | Stramer | 482/100 |
| 4,623,144 | 11/1986 | Rockwell . | |
| 4,626,112 | 12/1986 | Kramer . | |
| 4,627,619 | 12/1986 | Rockwell et al. . | |
| 4,678,186 | 7/1987 | McIntyre . | |
| 4,725,056 | 2/1988 | Rehrl et al. | 482/134 |
| 4,728,102 | 3/1988 | Pauls | 482/118 |
| 4,753,438 | 6/1988 | Paris et al. . | |
| 4,834,396 | 5/1989 | Schnell . | |
| 4,836,536 | 6/1989 | Jones . | |
| 4,884,801 | 12/1989 | Schnell . | |
| 4,893,812 | 1/1990 | Dawson, Jr. et al. . | |
| 4,979,734 | 12/1990 | Sims | 482/137 X |
| 5,056,779 | 10/1991 | Webb | 482/100 X |
| 5,110,121 | 5/1992 | Foster | 482/137 |

FOREIGN PATENT DOCUMENTS 2544618 10/1984 France .

OTHER PUBLICATIONS

"Document A" Torsilastic Product Literature.

*Primary Examiner*—Robert Bahr

[57] ABSTRACT

The prevent invention provides an apparatus 100 of a type on which a person exercises. The apparatus 100 includes a support frame 101 and a chair member 102 that is rotatably mounted to the support frame 101. A rotational resistance means 105 is also mounted to the support frame 101. The rotational resistance means 105 includes conical surfaces 255 and 256 that provide frictional resistance through interengagement between one of thirty-two teeth 257 on shaft member 154 and one of three ratcheting members 258*a–c* on rotatable friction member 155. A rotational arm means 106 is operatively connected to the rotational resistance means 105 to allow application of a rotational force in a given direction of rotation against the rotational resistance means 105. A foot anchor means 103 is mounted to the support frame 101, so that a person seated in the chair member 102 may anchor his feet beneath the foot anchor means 103 in order to perform abdominal flexions. Also, a foot brace means 104 is mounted to the support frame 101, so that a person seated in the chair member 102 may brace his feet against the foot anchor means 104 in order to perform abdominal flexions. Additionally, a pelvis stabilization means 107 and a thigh stabilization means 108 are operatively connected to the chair member 102 to stabilize the pelvis and the thighs, respectively, of a person seated in the chair member 101.

15 Claims, 18 Drawing Sheets

MULTI-PURPOSE TORSO EXERCISE APPARATUS

FIELD OF THE INVENTION

The present invention relates generally to exercise apparatus, and more particularly, to a multi-purpose torso exercise apparatus designed to facilitate exercise of the abdominal, lower back, and lateral oblique muscle groups.

BACKGROUND OF THE INVENTION

There is a trend in exercising and body-building toward more concentrated exercises designed to isolate and intensively work individual muscles or muscle groups. In keeping with this trend, manufacturers of exercise and body-building equipment have designed entire lines of specialty equipment with each piece of equipment dedicated to a particular muscle or muscle group. Two obvious problems with such equipment are that a great deal of money is required to obtain all of the equipment needed for a full body workout, and a great deal of space is required to store and operate all of the necessary equipment. Additionally, such equipment rarely provides any mechanism to ensure that the person using the equipment is not shifting the exercise load away from the intended muscle or muscle group, thus defeating the purpose of the specialty equipment. The present invention addresses these problems and others by providing a relatively inexpensive and compact apparatus suitable for reliable exercise of the abdominal, lower back, and lateral oblique muscle groups.

SUMMARY OF THE INVENTION

The present invention provides an apparatus of a type on which a person exercises. The apparatus includes a support frame and a chair member that is mounted to the support frame. A rotational resistance means is also mounted to the support frame, and it is designed to provide passive, one way resistance to rotation in a given direction up to a given load. A rotational arm means is operatively connected to the rotational resistance means, and it is designed to receive a rotational force in the given direction of rotation. A foot anchor means is mounted to the support frame, so that a person seated in the chair member may anchor his feet behind the foot anchor means in order to perform abdominal flexions. Also, a foot brace means is mounted to the support frame, so that a person seated in the chair member may brace his feet against the foot brace means in order to perform lower back flexions. A pelvis stabilization means is operatively connected to the chair member to stabilize the pelvis of a person seated in the chair member during the performance of such exercises.

In a preferred embodiment, the rotational resistance means includes a fixed friction member having a conical internal surface, and a rotatable friction member having a mating conical external surface. Rotation of the rotatable friction member relative to the fixed friction member is opposed by friction between the mating conical surfaces, which provides entirely passive resistance to rotation. One of thirty-two teeth on a shaft member engages one of three ratcheting members on the rotatable friction member to rotate the rotatable friction member in a first direction relative to the fixed friction member. However, upon rotation of the shaft in a second, opposite direction, the ratcheting members readily pass over the teeth, so that the frictional resistance against rotation is provided in a single direction.

In a preferred embodiment, the chair member includes a seat member and a split back member, and the chair member is rotatable among a plurality of orientations. In a first orientation, the chair member faces the foot anchor means, and the apparatus is in a first configuration suitable for abdominal flexion exercises. In a second orientation, the chair member faces the foot brace means, opposite the foot anchor means, and the apparatus is in a second configuration suitable for lower back flexion exercises. In a third orientation, the chair member faces away from the rotational resistance means, and the apparatus is in a third configuration suitable for right side flexion exercises. In a fourth orientation, the chair member faces toward the rotational resistance means, and the apparatus is in a fourth configuration suitable for left side flexion exercises. Additionally, a thigh stabilization means is operatively connected to the chair member to stabilize the thighs of a person seated in the chair member during the performance of such exercises.

The preferred embodiment of the present invention provides a relatively inexpensive and compact apparatus suitable for reliable exercise of the abdominal, lower back, and lateral oblique muscle groups. The pelvis stabilization means and thigh stabilization means help ensure that the exercising person does not transfer the exercise load away from the desired muscles or muscle groups. Additionally, the split back member of the chair member provides support for the back of the exercising person, as well as a point of reference for the person returning to an upright seated position.

The distances between the chair member and the foot anchor means, and between the chair member and the foot brace means are adjustable, so that persons of various sizes may be accommodated. Also, the height of the rotational resistance means relative to the chair member is such that the axis of rotation of the rotational arm means substantially aligns with the hips of a person seated in the chair member, regardless of the person's size. Thus, not only does the rotational resistance means provide smooth, passive, and one way resistance, but it also provides uniform resistance throughout the range of exercise motion. These and other advantages will become apparent to those skilled in the art upon a more detailed description of the preferred embodiment.

BRIEF DESCRIPTION OF THE DRAWING

Referring to the Figures, which are drawn to scale and wherein like numerals represent like parts throughout the several views.

DETAILED DESCRIPTION OF A PREFERRED EMBODIMENT

Figure 1:
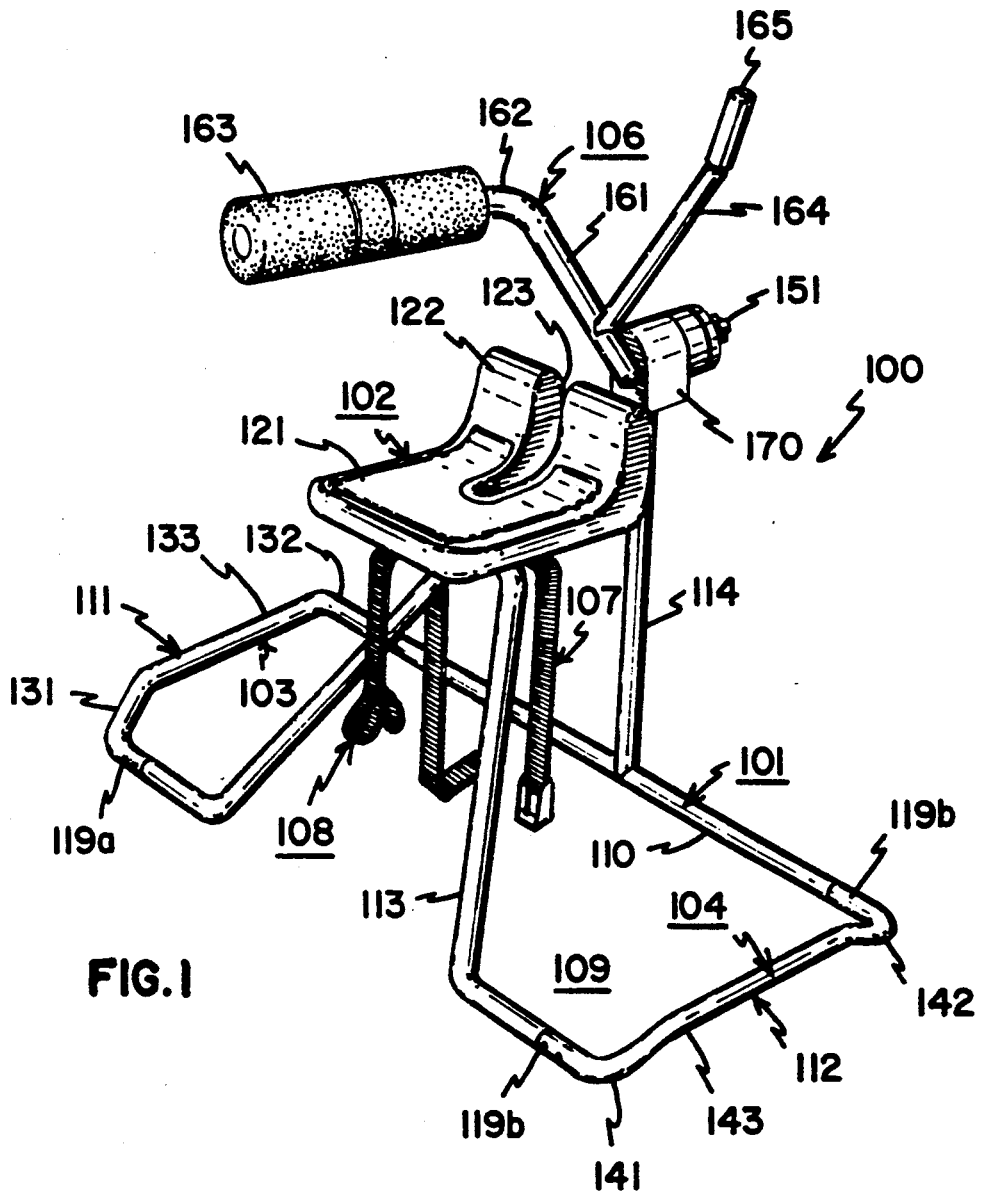
FIG. 1 is a perspective view of a preferred embodiment of an exercise apparatus constructed according to the principles of the present invention.

Referring to FIGS. 1 through 7, a preferred embodiment of an exercise apparatus constructed according to the principles of the present invention is designated generally at 100. The exercise apparatus 100 includes a support frame 101, a chair member 102, a foot anchor means 103, a foot brace means 104, a rotational resistance means 105, a rotational arm means 106, a pelvis stabilization means 107, and a thigh stabilization means 108.

In the preferred embodiment, the support frame 101 is constructed of one and one-half inch diameter steel tubing. The support frame 101 includes a substantially planar base member 110, which is designed to rest upon a floor surface 109 when the apparatus 100 is in an operable position. The base member 110 extends between first and second ends defined by the lateral portions of U-shaped first and second end members 111 and 112, respectively. Bolts 119*a* and 119*b* pass through mating holes in the end members 111 and 112 and their counterparts on opposing portions of the remainder of the base member 110 to secure the end members 111 and 112 relative to the remainder of the base member 110.

A chair support member 113 extends up from the front of the base member 110 intermediate the end members 111 and 112. The chair support member 113 defines an oblique angle relative to the plane of the base member 110 and thus, the floor surface 109, and the chair support member 113 may be described as leaning toward the rear of the apparatus 100. A post member 114 extends perpendicularly up from the rear of the base member 100 intermediate the end members 111 and 112, and a lateral member 115 extends between the chair support member 113 and the post member 114 to stabilize the support frame 101 and distribute the weight of a person sitting on the chair member 102.

The chair member 102 is rotatably mounted to the support frame 101 proximate the juncture between the chair support member 113 and the lateral member 115. A preferred embodiment of the chair member 102 is disclosed-. in detail in U.S. Pat. No. 5,122,105, which was filed on Aug. 31, 1990, and is assigned to the same assignee as is the present application. To the extent that such disclosure is helpful in understanding the present invention, it is incorporated herein by reference. The chair member 102 includes a seat member 121 and a back member 122. The back member 122 includes a pair of wing members defining an elongate vertical slot 123 therebetween. The elongate vertical slot 123 provides clearance for the spine of a person seated in the chair member 102, and hence, the back member 122 may be referred to as a split back member. The split back member 122 provides clearance for a person's spine and comfortably engages the fleshy portions of the person's lower back and hips. Also, a springy steel insert (not shown) extends between the seat member 121 and the back member 122 to provide support for the person's back and yet allow the back member 122 to deflect relative to the seat member 121 as a person leans backward in the chair member 102. The one significant difference between the chair member 102 and that disclosed in U.S. Pat. No. 5,122,105 is that the chair member 102 is rotatably mounted to the support frame 101.

When the apparatus 100 is in an operable position, the seat member 121 defines a sitting surface that is substantially horizontal relative to the floor surface 109 and is located at a first elevation above the floor surface 109. The chair member 102 rotates about an axis perpendicular to the floor surface 109, so that the sitting surface remains parallel to the floor surface 109 independent of the orientation of the chair member 102. The axis of rotation of the chair member 102 is positioned relative to the post member 114 such that the chair member 102 is free to completely rotate 360 degrees without interference from the post member 114 or any other structure.

In a preferred embodiment, the foot anchor means 103 is defined by the first end member 111 and includes first and second elbow portions 131 and 132, integrally joined by an intermediate transverse member 133. The elbow portions 131 and 132 maintain the transverse member 133 at a second elevation above the floor surface 109 and relative to the base member 110. A person seated in the chair member 102 may anchor his feet behind the transverse member 133 during the performance of abdominal flexions, as will be discussed in greater detail below.

In a preferred embodiment, the foot brace means 104 is defined by the second end member 112 and includes first an second elbow portions 141 and 142, integrally joined by an intermediate transverse member 143. The elbow portions 141 and 142 maintain the transverse member 143 at a third elevation above the floor surface 109 and relative to the base member 110. A person seated in the chair member 102 may brace his feet against the transverse member 143 during the performance of lower back flexions, as will be discussed in greater detail below. In a preferred embodiment, the foot anchor means 103 and the foot brace means 104 are mirror images of one another, and the second elevation is equal to the third elevation.

In addition to providing support for the chair member 102, the post member 114 supports the rotational resistance means 105, which is mounted on the rear side of the post member 114 at a fourth elevation above the floor surface 109. The rotational resistance means 105 is mounted to the post member 114 above the point at which the lateral member 115 is connected to the post member 114. The rotational resistance means 105 is designed to oppose rotation in a given direction up to a given load, beyond which point the rotational resistance means 105 rotates at a smooth and constant resistance.

Figure 21:
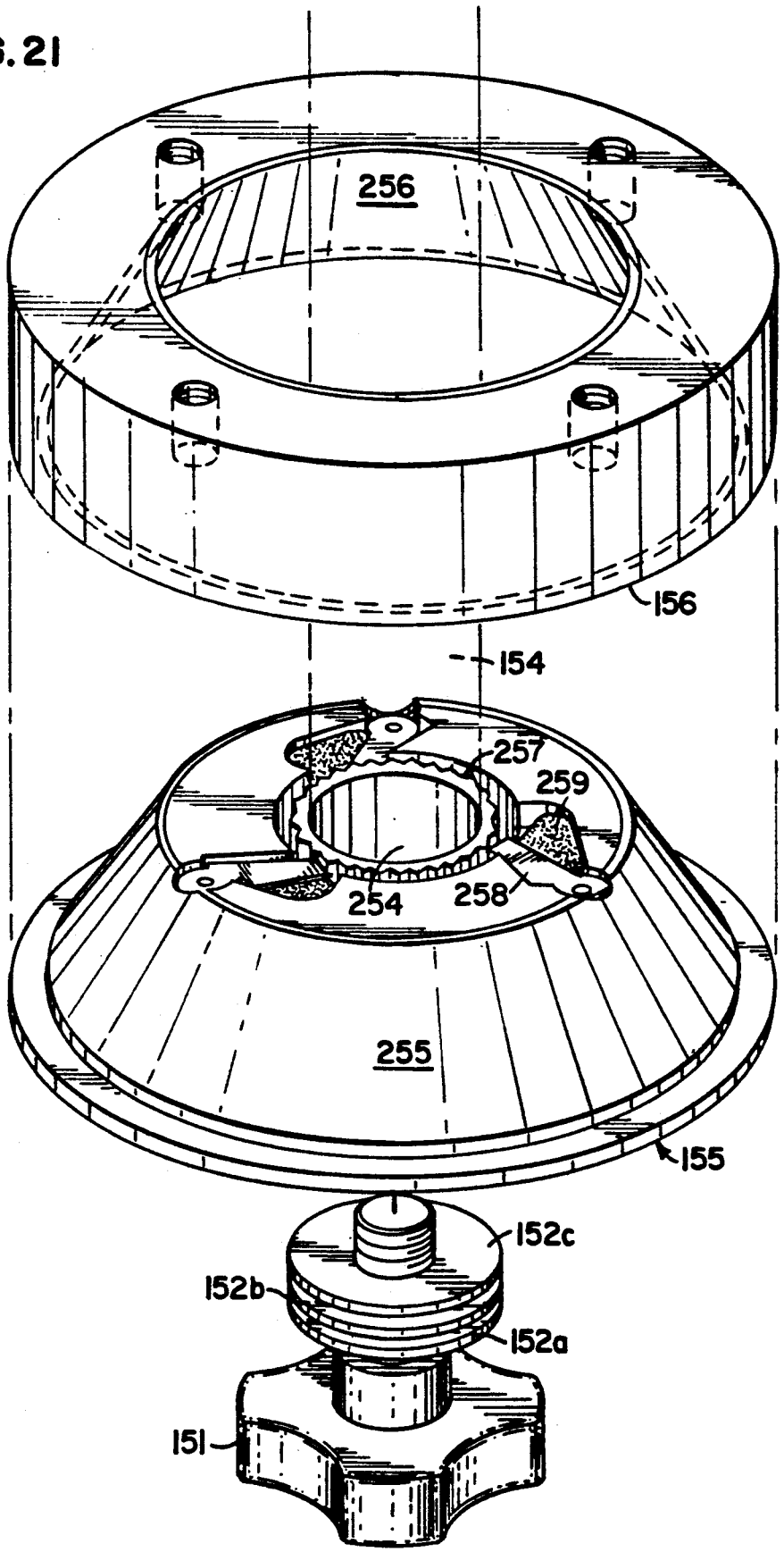
FIG. 21 is an enlarged and exploded perspective view of the rotational resistance means shown in FIG. 19.
Figure 22:
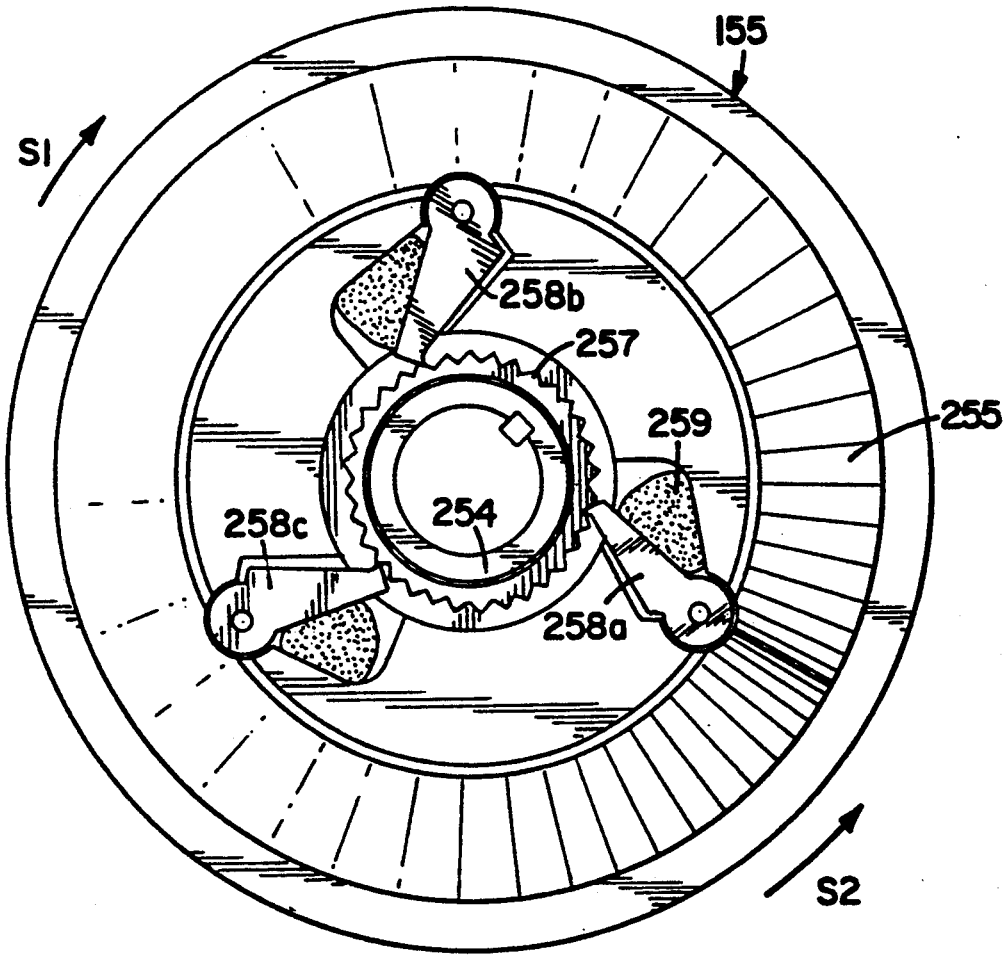
FIG. 22 is an enlarged front view of the rotatable friction member comprising a part of the rotational resistance means shown in FIG. 19.

Referring to FIGS. 19 through 22, in a preferred embodiment the rotational resistance means 105 includes a fixed friction member 156 secured relative to the support frame 101 by means of a U-shaped bracket 157 and a tube member 158, both of which are rigidly secured to the post member 114. A housing member 170 (shown in phantom in FIG. 19) conceals the tube member 158 and the interior of the U-shaped bracket 157. Referring to FIGS. 21 and 22, the fixed friction member 156 has a conical internal surface 256 that is coated with a plastic known in the art as UH-MW. The conical internal surface 256 faces rearward from the post member 114 and is designed to mate with a forwardly facing conical external surface 255 on a coaxially aligned rotatable friction member 155. The conical external surface 255 is coated with rubber, and rotation of the rotatable friction member 155 relative to the fixed friction member 156 is resisted by a frictional force between the rubber-coated conical external surface 255 and the plastic-coated conical internal surface 256.

A shaft member 154 is coaxially aligned relative to the fixed friction member 156 and the rotatable friction member 155 and passes through centrally located openings therein. The shaft member 154 has a first end that is rigidly secured to the rotational arm means 106, and an opposite, second end that secures to a frictional force adjustment knob 151. A large metal washer **159*b* is rigidly secured to the rotational arm means 106, and a large nylon washer 159*a* is positioned between the large metal washer 159*b* and the tube member 158. The washers 159*a* and 159*b* are included in the preferred embodiment to facilitate rotation of the rotational arm means 106 relative to the tube member 158. From the rotational arm means 106, the shaft member 154 passes through the large washers 159*b* and 159*a*, the tube member 158, the fixed friction member 156, the rotatable friction member 155, and a large washer 153, which is intermediate the rotatable friction member 155 and the knob 151. That portion of the shaft member 154 which passes through the rotatable friction member 155 has teeth 257 disposed about its circumference. In the embodiment shown in FIG. 22, the teeth 257 are part of a separate ring member 254 that secures to the shaft member 154 by means of a keyway arrangement. Upon rotation of the shaft member 154 in a first shaft direction S1, one of the teeth 257 is engaged by one of a plurality of ratcheting members 258*a–c*, which are pivotally mounted on said rotatable friction member 155. The three ratcheting members 258 are positioned about the perimeter of the thirty-two teeth 257 in such a manner that only one ratcheting member 258*a–c* is capable of engaging any of the teeth 257 at any given time. For example, in FIG. 22, ratcheting member 258*a* is presently engaging one of the teeth 257, so that upon rotation of the shaft member 154 in the first shaft direction S1, the rotatable friction member rotates in conjunction with the shaft member 154 and relative to the fixed friction member 156**.

Upon rotation of the shaft member 154 in a second shaft direction S2, opposite the first shaft direction S1, the ratcheting members pass over the teeth 257, and the shaft member 154 is free to rotate relative to the rotatable friction member 155, as well as the fixed friction member 156. A slight rotation in the second shaft direction S2 will cause ratcheting member **258*b* to come into engagement with one of the teeth 257. Those skilled in the art will recognize that the present invention provides the benefit of ninety-six incremental engagement orientations in one revolution of the shaft member 154, but without compromising the integrity of each engagement increment; each of thirty-two teeth can be made larger and stronger than each of ninety-six teeth disposed about a given circumference. Foam members 259*a–c* are placed within the cavities in which the ratcheting members 258*a–6* pivot to minimally force the ratcheting members 258*a–6* into engagement with the teeth 257 and to minimize noise from operation of the rotational resistance means 105**.

The frictional force adjustment knob 151 is secured relative to the second end of the shaft member 154 by means of interengaging threads on the knob 151 and the second end of the shaft member 154. As noted above, the shaft member 154 passes through the large washer 153, which is located between the knob 151 and the rotatable friction member 155. Additionally, as shown in detail in FIG. 21, a small washer **152*a*, a small thrust bearing 152*b*, and a small washer 152*c* are located between the knob 151 and the large washer 153. The structure is such that rotation of the knob 151 in a first knob direction relative to the shaft member 154 forces the rotatable friction member 155 toward the fixed friction member 156, thereby increasing the frictional force between the conical internal surface 256 and the conical external surface 255. Conversely, rotation of the knob 151 in a second knob direction relative to the shaft member 154 relaxes the force of the rotatable friction member 155 against the fixed friction member 156, thereby decreasing the frictional force between the conical internal surface 256 and the conical external surface 255**.

Figure 2:
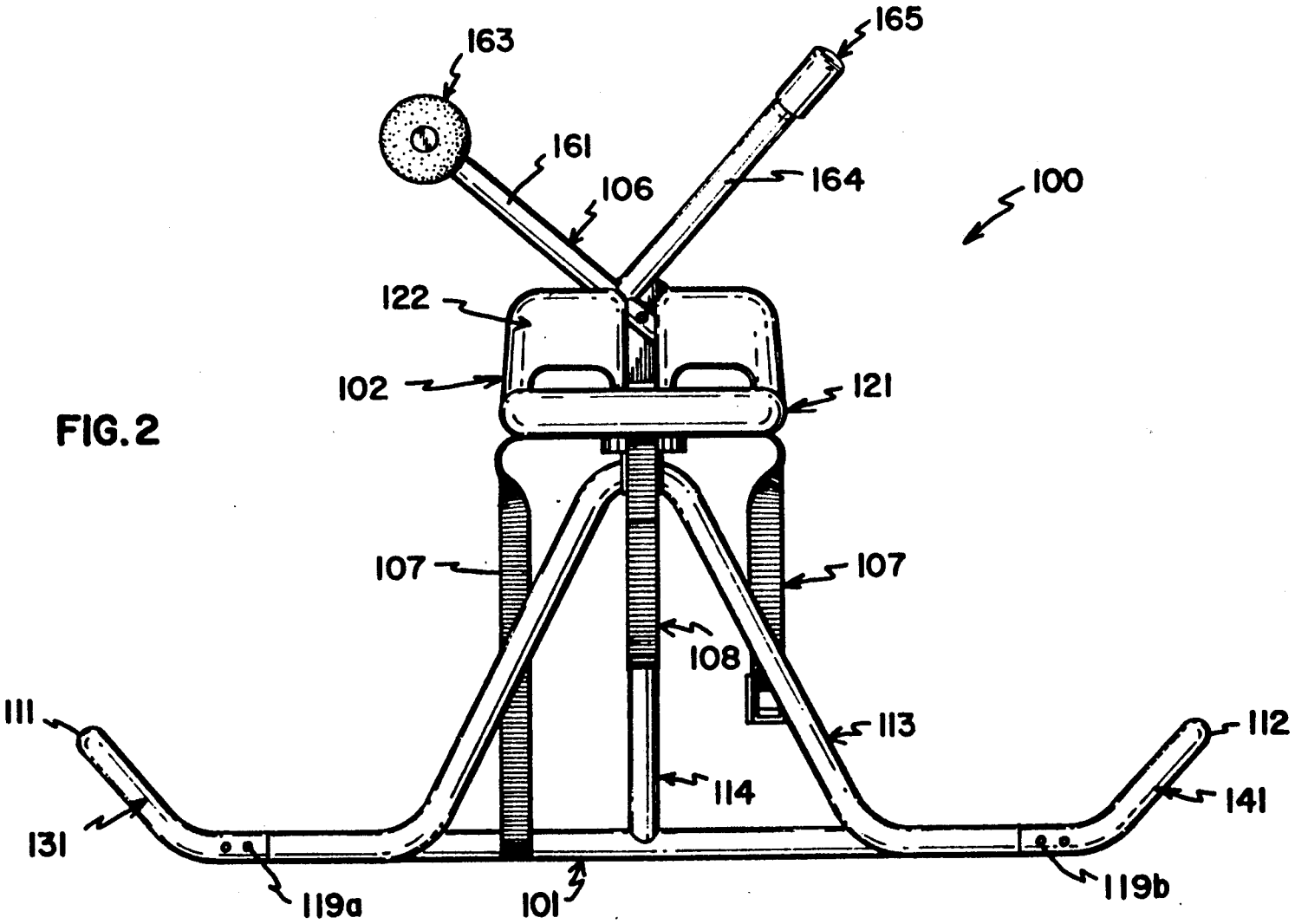
FIG. 2 is a front view of the preferred embodiment exercise apparatus shown in FIG. 1.
Figure 3:
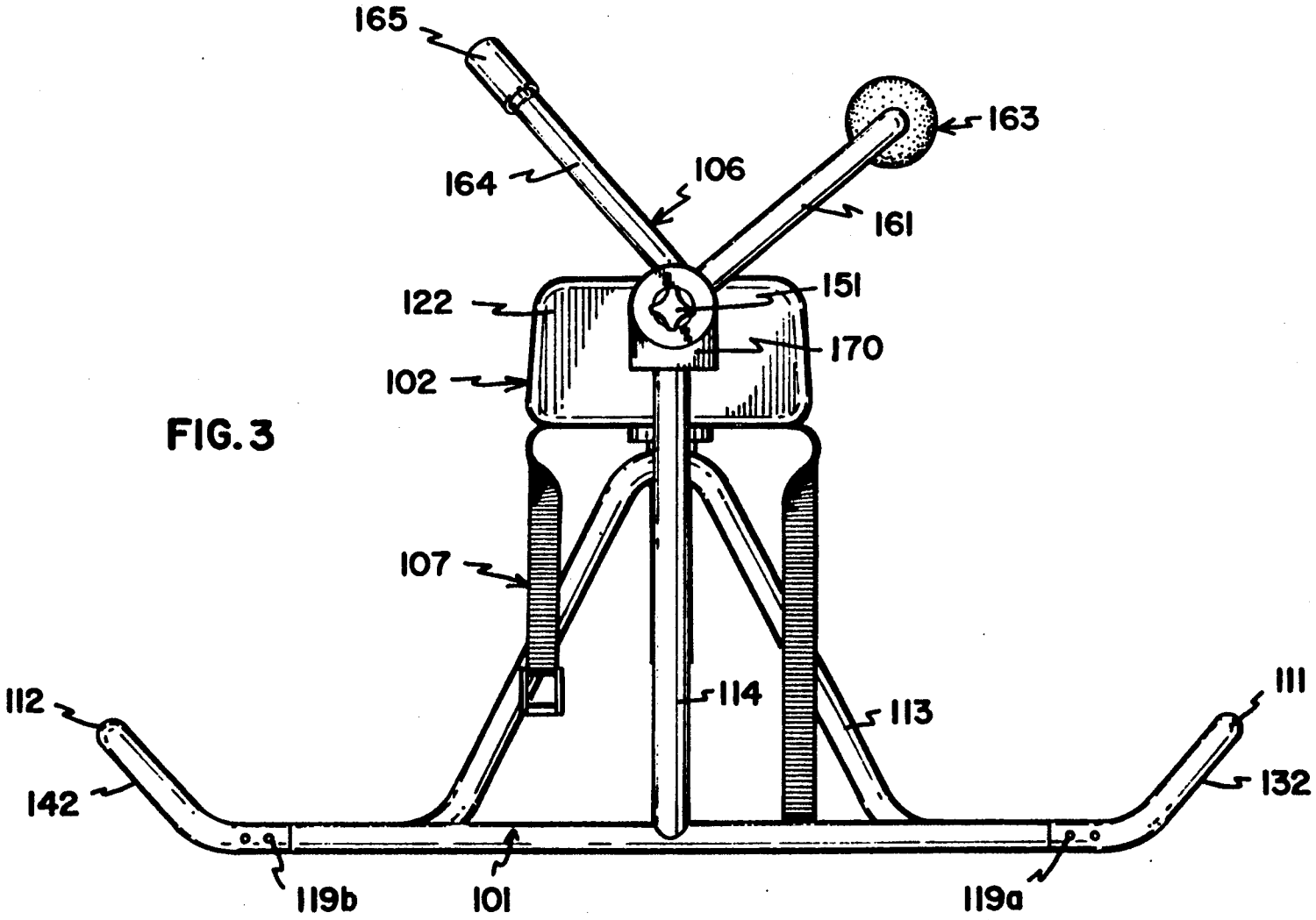
FIG. 3 is a rear view of the preferred embodiment exercise apparatus shown in FIG. 1.
Figure 5:
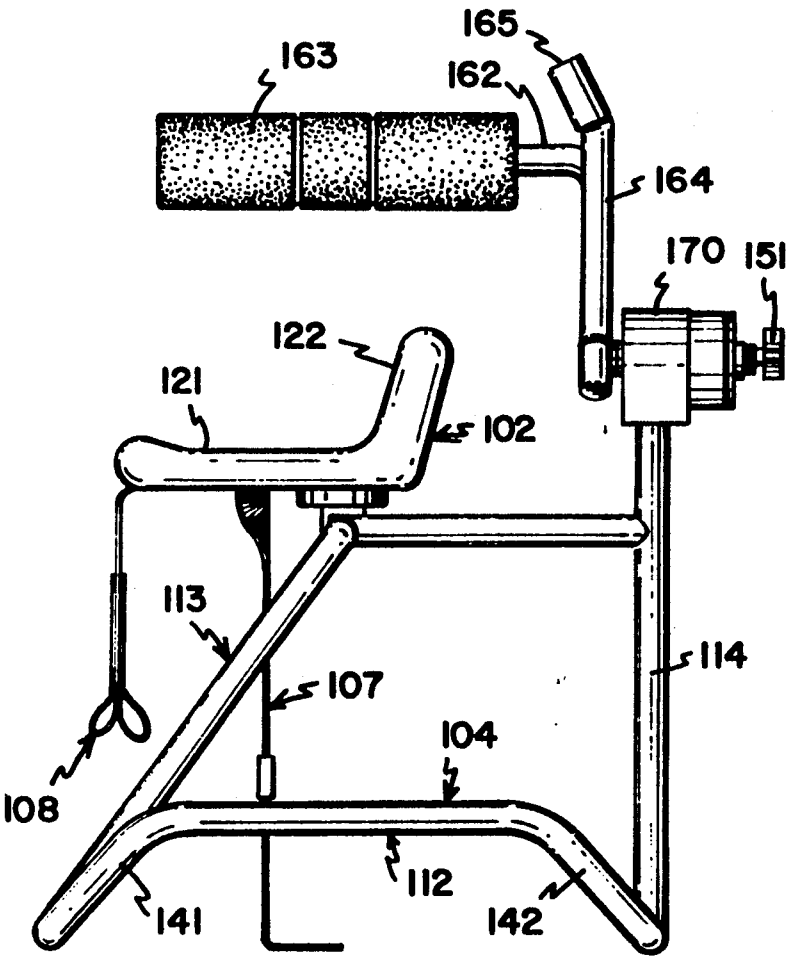
FIG. 5 is a right side view of the preferred embodiment exercise apparatus shown in FIG. 1.
Figure 4:
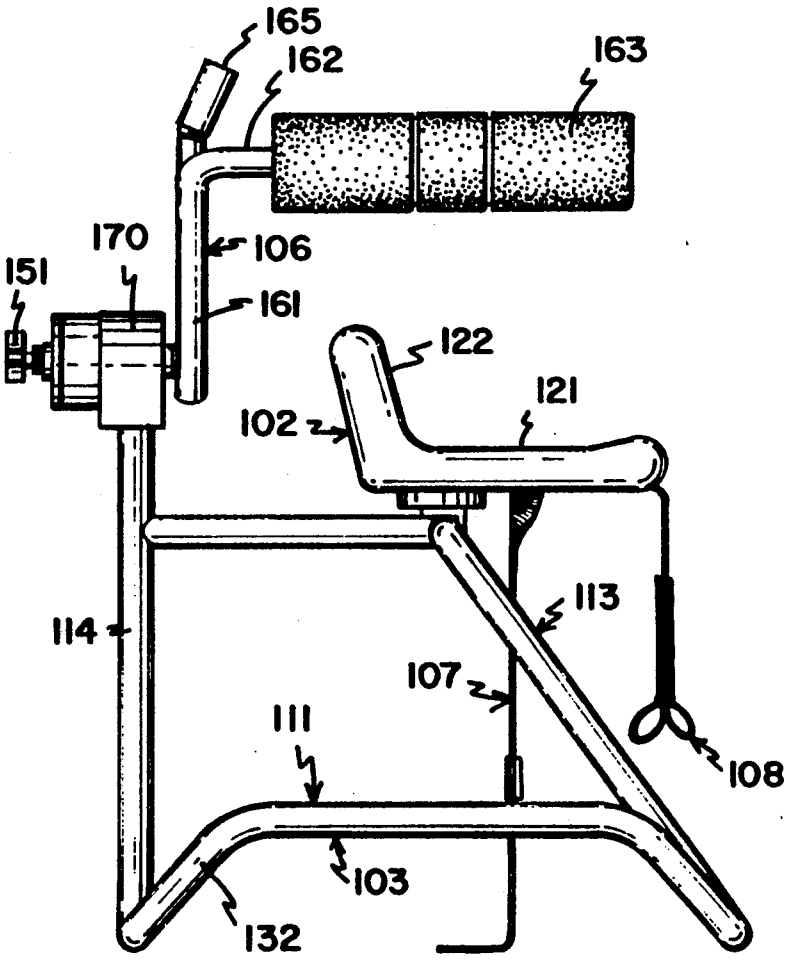
FIG. 4 is a left side view of the preferred embodiment exercise apparatus shown in FIG. 1.
Figure 6:
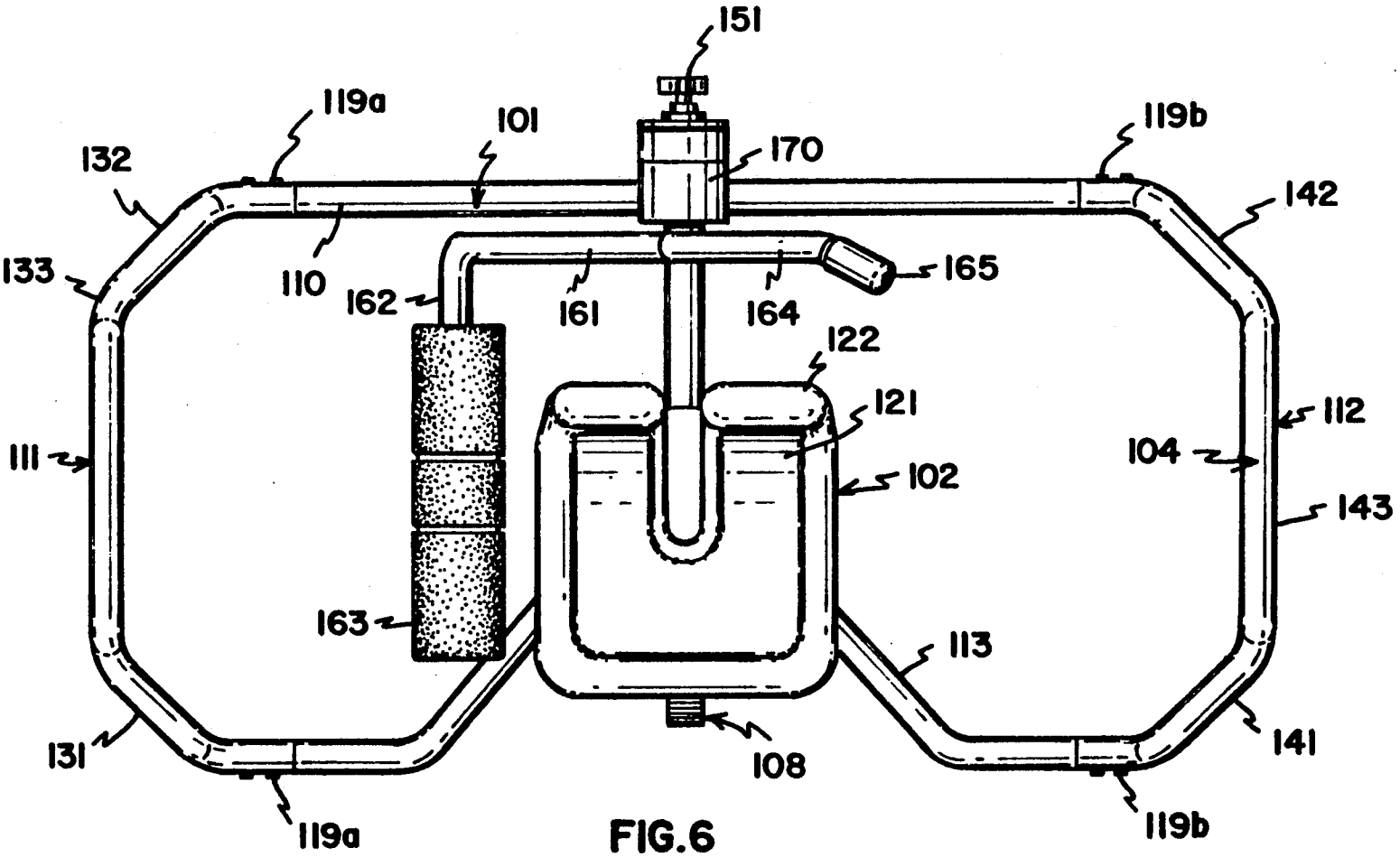
FIG. 6 is a top view of the preferred embodiment exercise apparatus shown in FIG. 1.
Figure 7:
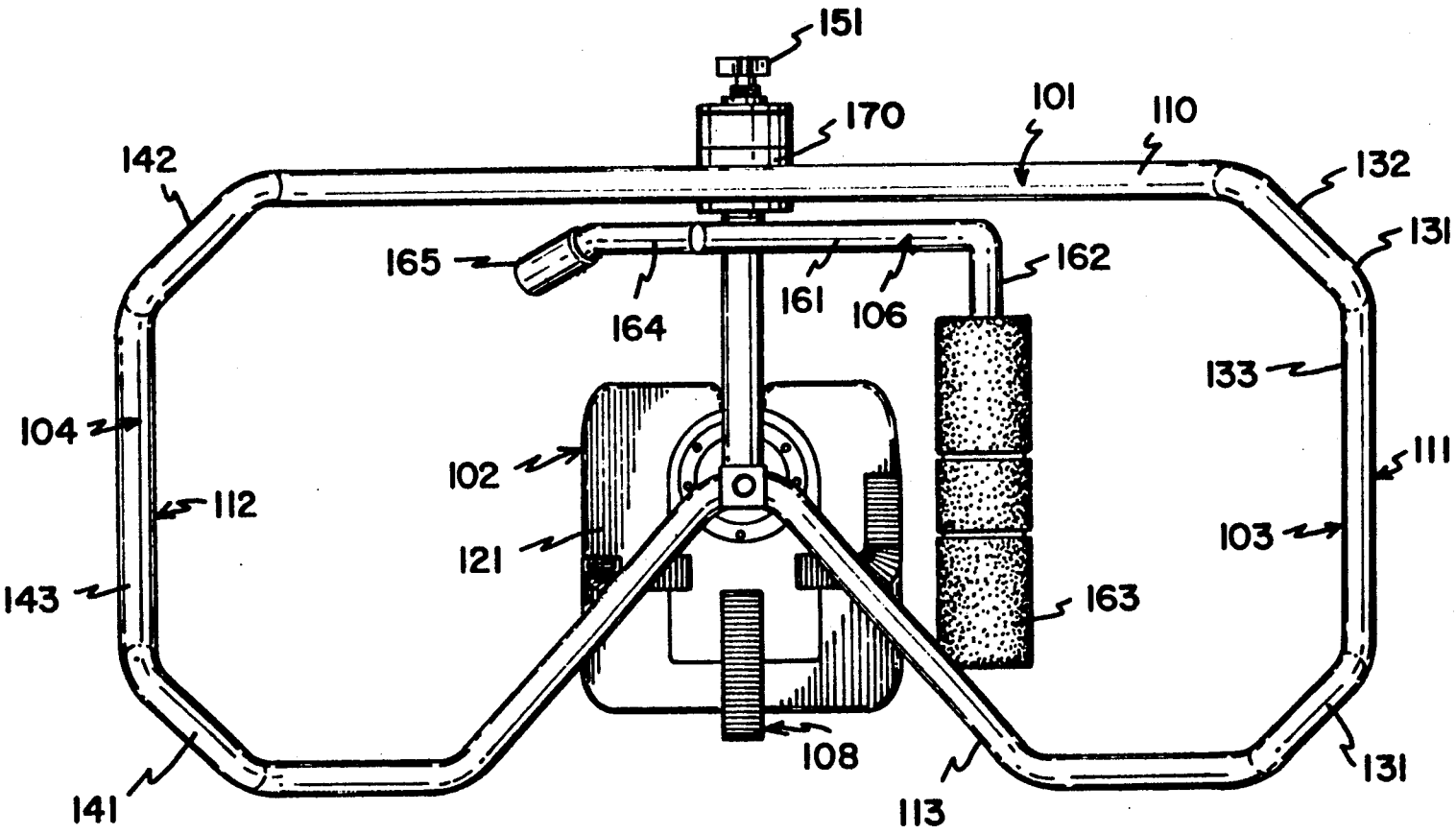
FIG. 7 is a bottom view of the preferred embodiment exercise apparatus shown in FIG. 1.
Figure 8:
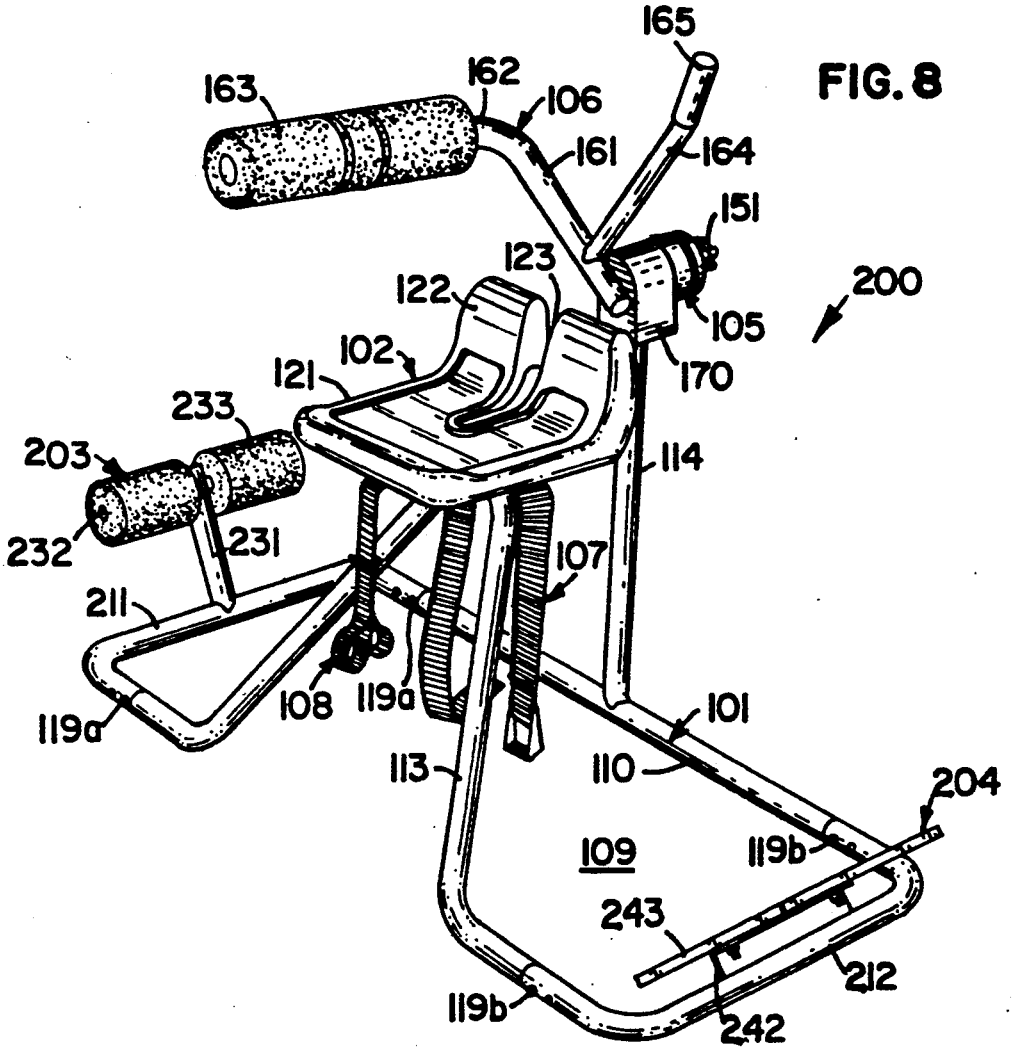
FIG. 8 is a perspective view of a alternative embodiment of an exercise apparatus constructed according to the principles of the present invention.
Figure 9:
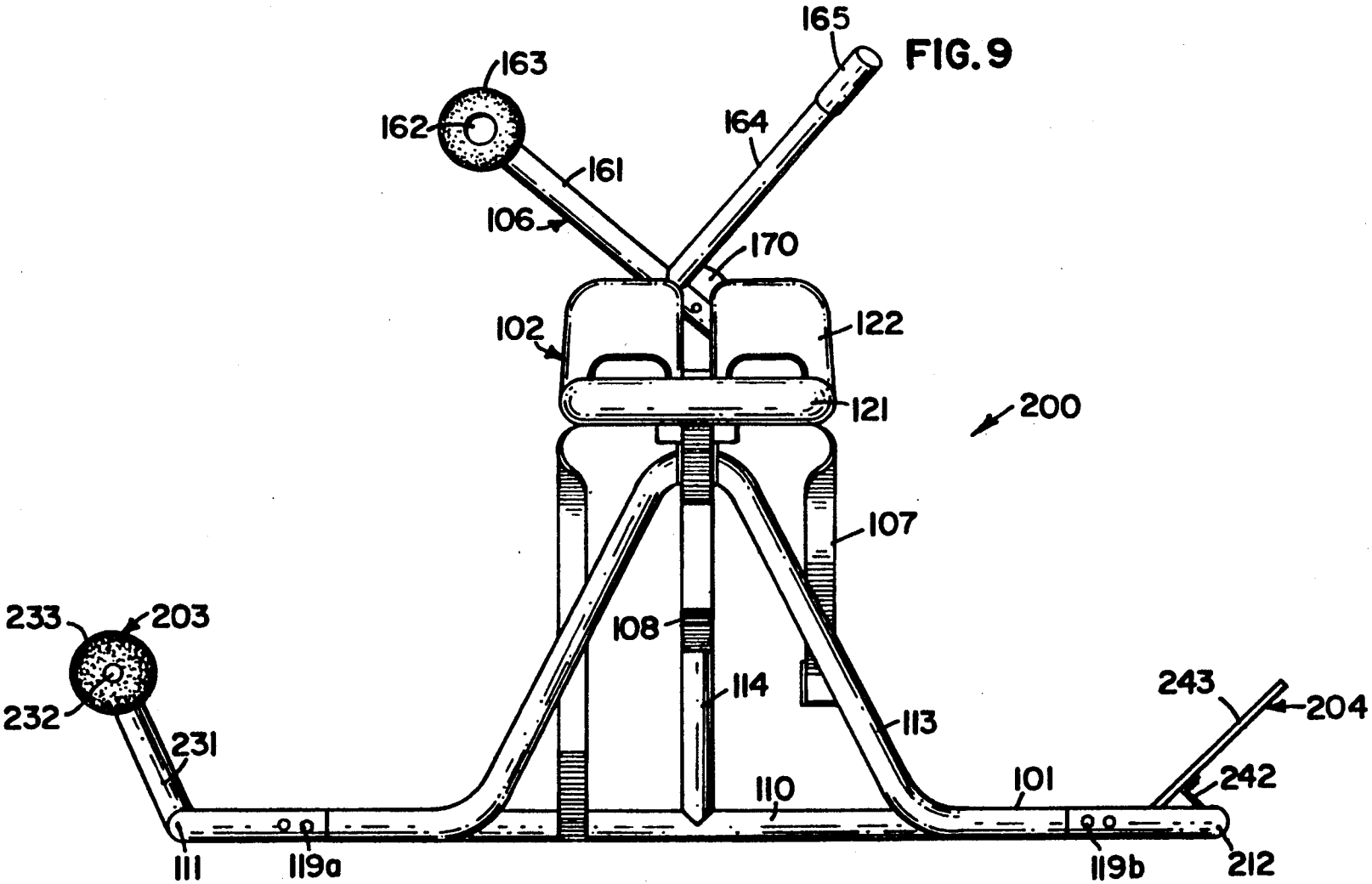
FIG. 9 is a front view of the alternative embodiment exercise apparatus shown in FIG. 8.
Figure 10:
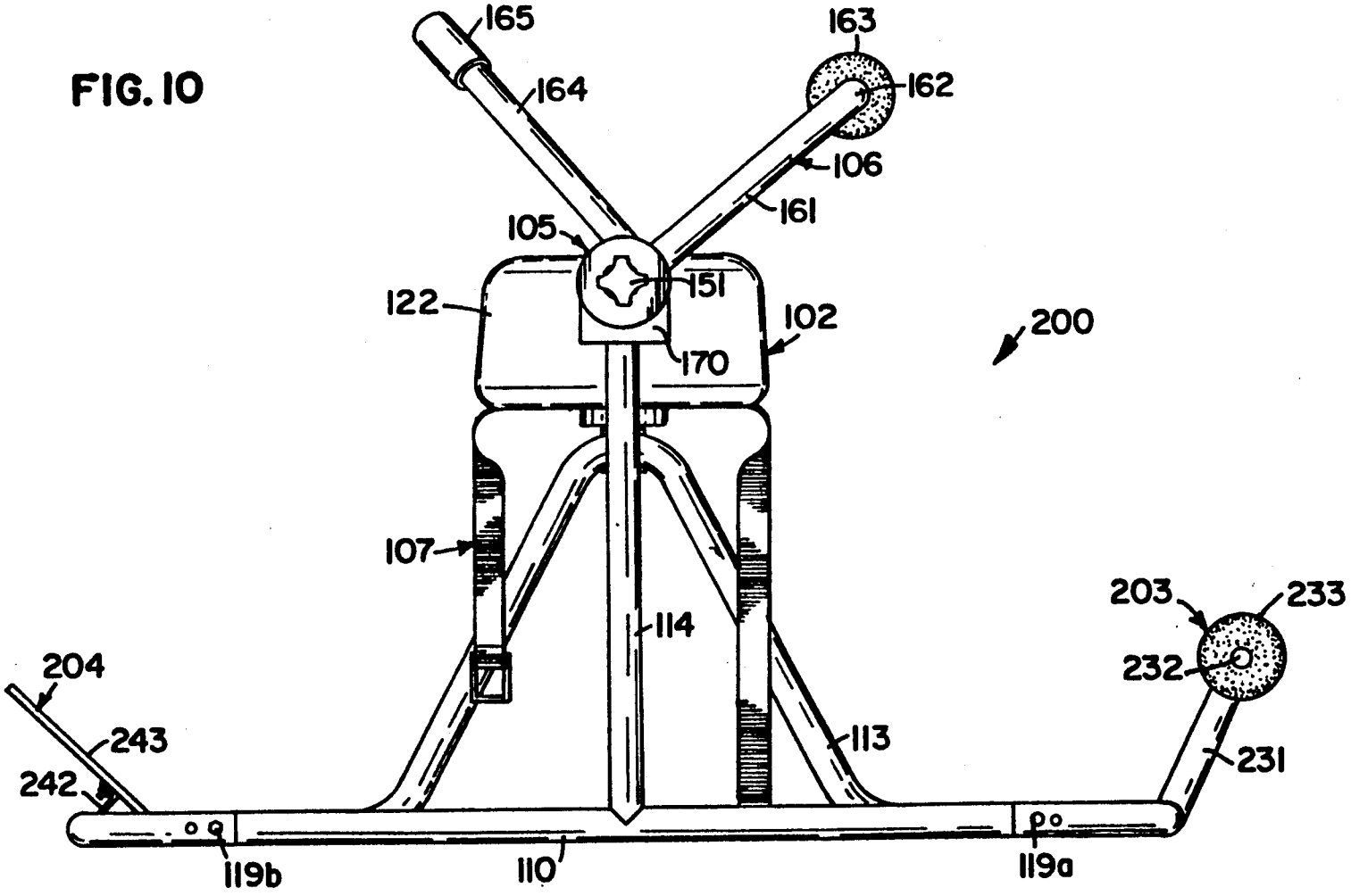
FIG. 10 is a rear view of the alternative embodiment exercise apparatus shown in FIG. 8.
Figure 12:
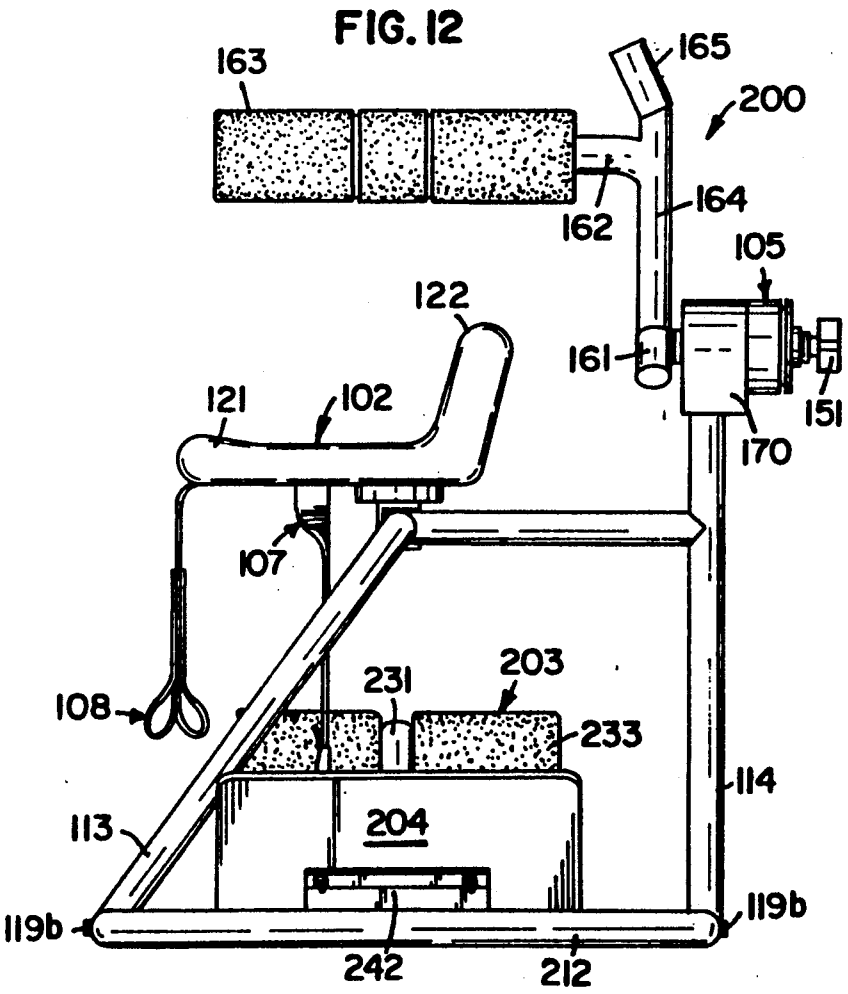
FIG. 12 is a right side view of the alternative embodiment exercise apparatus shown in FIG. 8.
Figure 11:
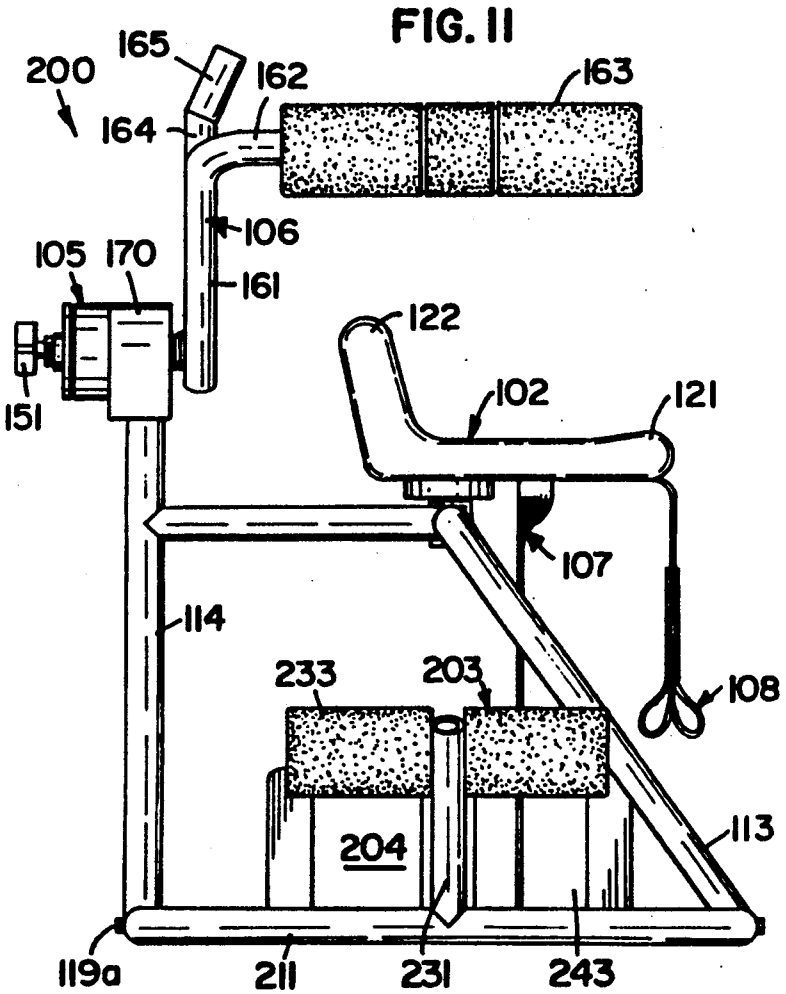
FIG. 11 is a left side view of the alternative embodiment exercise apparatus shown in FIG. 8.
Figure 13:
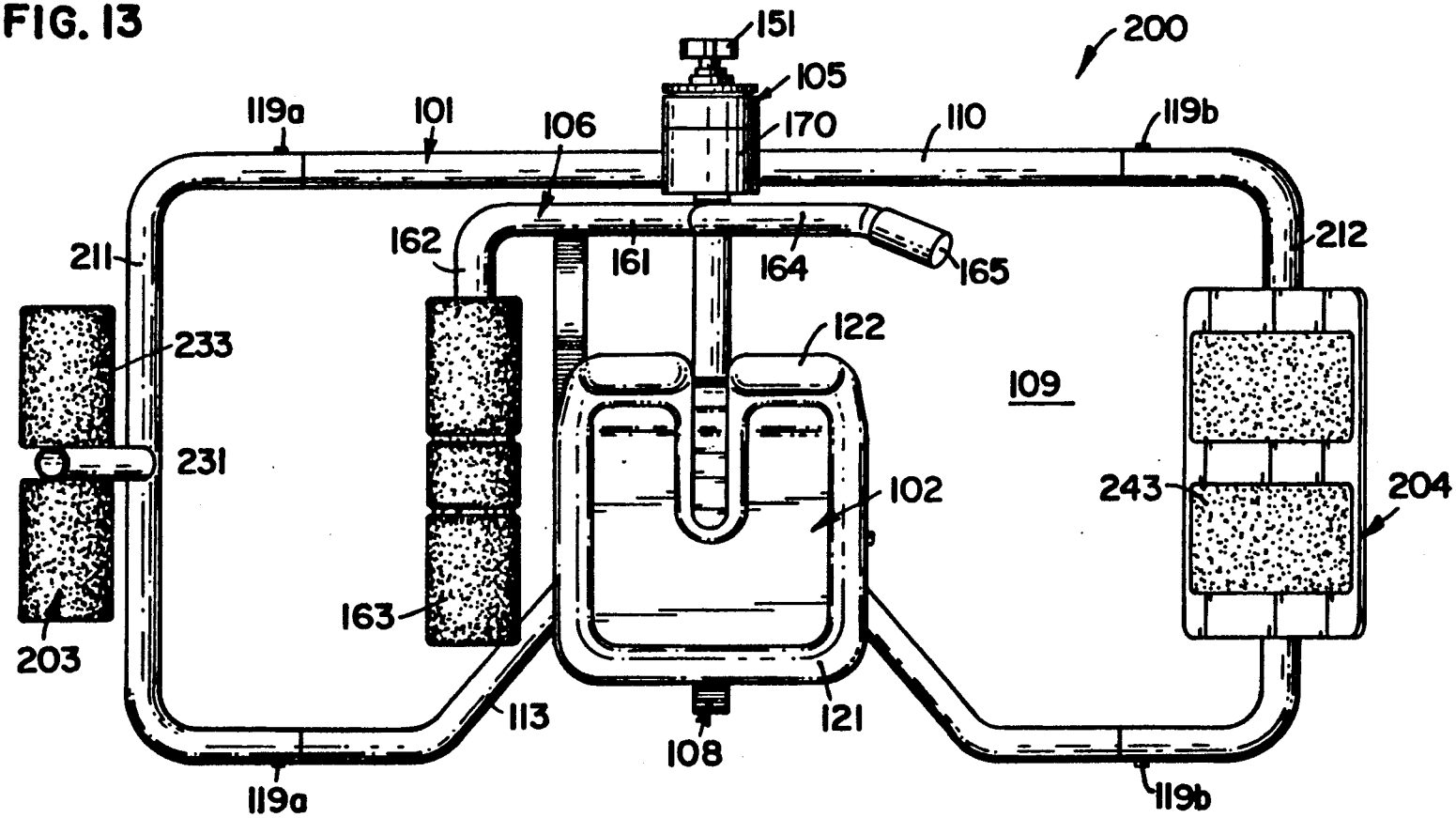
FIG. 13 is a top view of the alternative embodiment exercise apparatus shown in FIG. 8.
Figure 14:
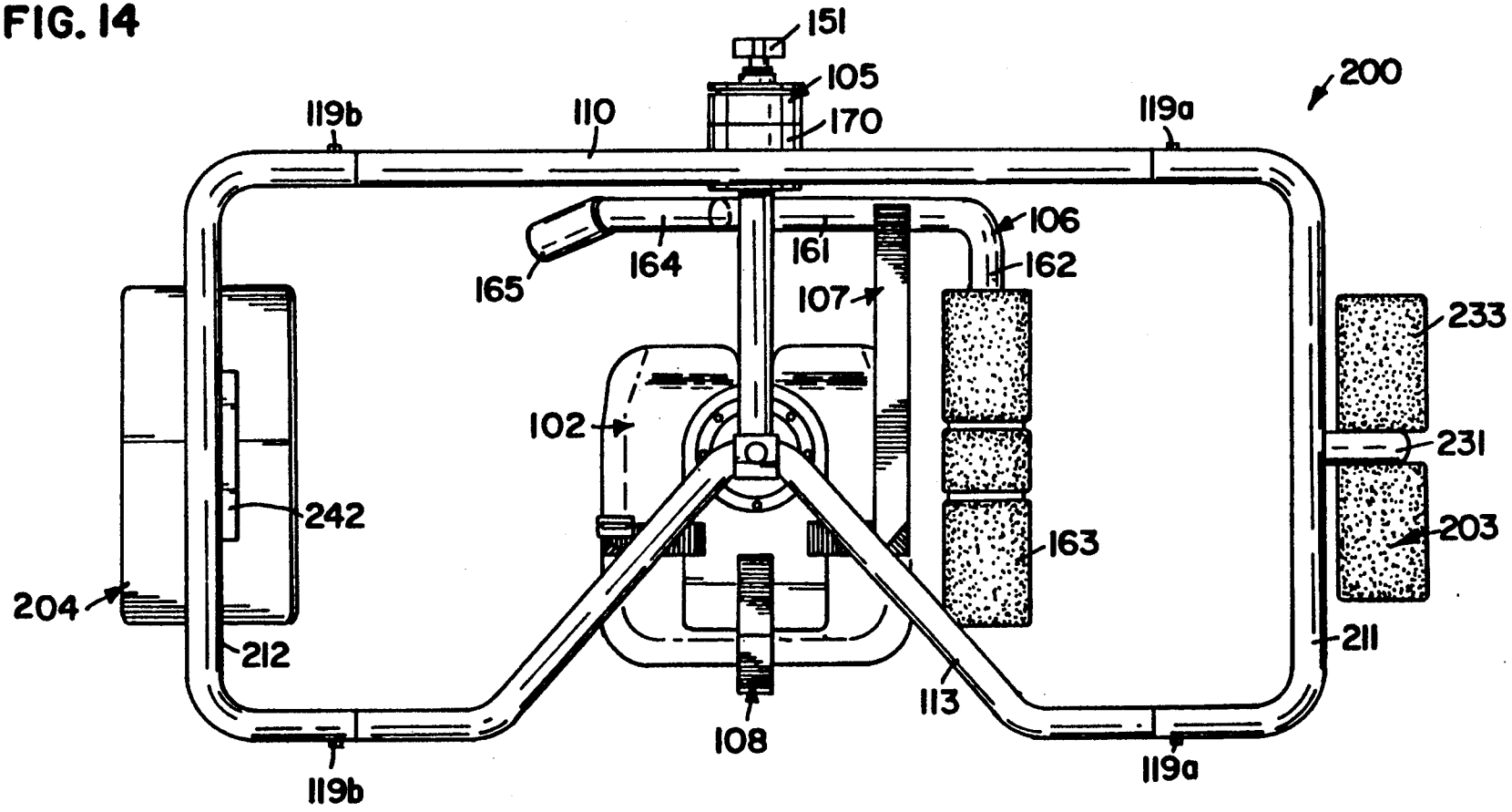
FIG. 14 is a bottom view of the alternative embodiment exercise apparatus shown in FIG. 8.

In operation, upon rotation of the rotational arm means 106 and the shaft member 154 in the first shaft direction S1, the rotatable friction member 155 and everything to the rearward side thereof rotate with the shaft member 154 in the first shaft direction S1 relative to the fixed friction member 156 and the tube member 158. On the other hand, upon rotation of the rotational arm means 106 and the shaft member 154 in the second shaft direction S2, only the knob 151 and one or more of the washers **152*a–6* rotate with the shaft member 154 in the second shaft direction S2 relative to the rotatable friction member 155, as well as the fixed friction member 156. Thus, the rotational resistance means 105 provides rotational resistance in a single direction S1, counter-clockwise as you face the apparatus 100 (FIG. 2). In a preferred embodiment, upon release of a rotational load on the rotational resistance means 105, it does not automatically return to a start position. In other words, the resistance to rotation is entirely passive, and there is never a load acting upon the person exercising. Yet those skilled in the art will recognize that an automatic return to a start position can be provided by adding some type of spring mechanism (not shown) to "unwind" the rotation. However, the spring force should be limited to what is necessary to return the rotational resistance means 105** to a start position, so that the resistance to rotation remains as passive as possible.

The rotational arm means 106 is operatively connected to the rotational resistance means 105 in such a manner that the rotational arm means 106 rotates in conjunction with the shaft member 154, the cone member 155 (in one direction S1), and the knob 151, relative to the fixed members the rotational resistance means 105, including the shaft support member 158 and the fixed friction member 156. The plane of rotation of the rotational arm means 106 is perpendicular to the floor surface 109, as well as the lateral members 133 and 143.

Referring back to FIGS. 1-7, the rotational arm means 106 includes a radial member 161 that is rigidly secured perpendicularly to the shaft member 154 and extends in a direction parallel to the plane of rotation. An orbital member 162 extends perpendicularly from the radial member 161, and perpendicular to the plane of rotation. Recognizing that the plane of rotation of the rotational arm means 106 is proximate the rear of the apparatus 100, the orbital member 162 extends toward the front of the apparatus 100. The orbital member 162 is covered by a pad member 163 that provides a more comfortable support, against which the person applies force against the resistance provided by the rotational resistance means 105. The rotational arm means 106 further includes a support member 164 that extends perpendicularly from the radial member 161, and in a direction parallel to the plane of rotation. The support member 164 has a handle member 165 at its distal end, the significance of which will be discussed below.

The pelvis stabilization means 107 includes a belt member, or mating strap members, the ends of which are mounted beneath the planform of the chair member 102. Designed to operate similar to a seat belt, the strap members secure about the waist of a person seated on the chair member 102 and stabilize the person's pelvis relative to the seat member 121 and the back member 122. The thigh stabilization means 108 includes a tandem strap member, the end of which is mounted beneath the planform of the chair member 102. Extending out beyond the front of the chair member 102, the tandem strap member 108 secures separately about each of the legs of a person seated on the chair member 102, just below the person's knees, and stabilizes the person's thighs relative to the chair member 102. Those skilled in the art will recognize that these strap members may be fastened by velcro or buckles or other available means. The pelvis stabilization means 107 and the thigh stabilization means 108 help to prevent a person from shifting the exercise load from the intended muscles to other, stronger muscles, which would thereby defeat the purpose of the specifically tailored exercise.

Referring to FIGS. 8-14, an alternative embodiment of the present invention is designated generally at 200. The alternative embodiment corresponds to the preferred embodiment to the extent that like numerals are used to designate like parts on the respective embodiments. In the alternative embodiment 200, an alternative foot anchor means 203 includes an extension member 231 that extends from an alternative first end member 211. The foot anchor means 203 extends up from the floor surface 109 and away from the chair member 102, defining an oblique angle relative to the floor surface 109. The extension member 231 is connected to a transverse member 232 to form a T-shape at an alternative second elevation above the floor surface 109. A person seated in the chair member 102 is able to position one foot on each side of the extension member 231 and to the remote side of the transverse member 232. The transverse member 232 is covered by a pad member 233 that provides a more comfortable support behind which the person's feet are intended to be anchored, as will be discussed in greater detail below.

An alternative foot brace means 204 includes a bracket member 242 that extends from an alternative second end member 212. The bracket member extends up from the floor surface 109 and toward the chair member 102, defining an oblique angle relative to the floor surface 109. A platform member 243 is mounted at a right angle to the bracket member 242 to face substantially toward the chair member 102. The platform member 243 provides a surface at an alternative third elevation above the floor surface 109, against which the person's feet are intended to be braced, as will be discussed in greater detail below. In all respects other than the foot anchor means and the foot brace means, the alternative embodiment 200 is identical to the preferred embodiment 100.

Figure 15:
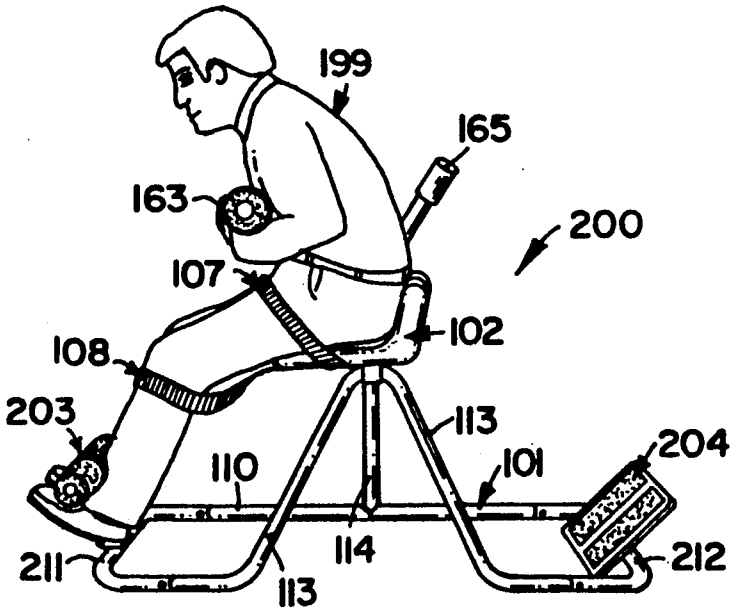
FIG. 15 is a front view of the alternative embodiment exercise apparatus shown in FIGS. 8-14, in a first configuration with a person using the apparatus to perform abdominal flexions.

Referring to FIG. 15, when the chair member 102 is rotated to a first orientation facing toward the foot anchor means 203 (or 103 in the preferred embodiment), the apparatus is in a first configuration suitable for abdominal flexions. The person 199 sits on the chair member 102 and secures the pelvis stabilization means 107 about his waist and the thigh stabilization means 108 about his legs. The person 199 then extends his legs, making any necessary adjustment to the thigh stabilization means 108 in the process, so that his feet are positioned on opposite sides of the extension member 231 and to the remote side of the pad member 233, with the tops of his feet up against the underside of the pad member 233. In the preferred embodiment, the tops of the person's feet would be positioned up against the underside of the lateral member 133. In this position, the person 199 will notice the orbital member 162 extending in front of his chest. The person 199 leans forward against the orbital member 162, and with his feet anchored behind the foot anchor means 203, the person 199 flexes his abdominal muscles to curl his torso forward and rotate the rotational arm means 106 against the resistance of the rotational resistance means 105. Where some type of return mechanism is provided, the person 199 simply returns to an upright seated position upon completion of the forward curl, and the rotational arm means 106 follows. Otherwise, the person 199 either retains the orbital member 162 as he returns to an upright seated position, or after returning to his starting position, the person 199 pulls on the handle member 165 to return the rotational arm means 106 to its starting position. The resistance provided by the rotational resistance means 105 is one-way, and no significant resistance is offered to the return of the rotational arm means 106 to a start position (because the ratcheting members 258*a–6* simply pass over the gear teeth 257).

The relative positioning of the chair member 102 at the first elevation and the rotational resistance means 105 at the fourth elevation is such that the axis of rotation of the rotational resistance means 105 and rotational arm means 106 approximately aligns with the natural axis of rotation at the hips of the person 199 performing the abdominal flexions. The alignment of the rotational axes of the rotational arm means 106 and the person's waist assures corresponding paths of motion and thus, a constant resistance to motion throughout the range of the exercise. Additionally, the relative positioning of the chair member 102 at the first elevation and the foot anchor means 203 at the alternative second elevation, as well as the overall distance therebetween, is calculated to accommodate persons of average size and within a range of such average size. Furthermore, the ends of the first end member 211 slidably engage their counterparts on the remainder of the base member 110, and series of mating holes are provided for bolts 119*a*, so that the distance between the foot anchor means 203 and the chair member 102 can be adjusted to accommodate persons of various sizes.

Figure 16A:
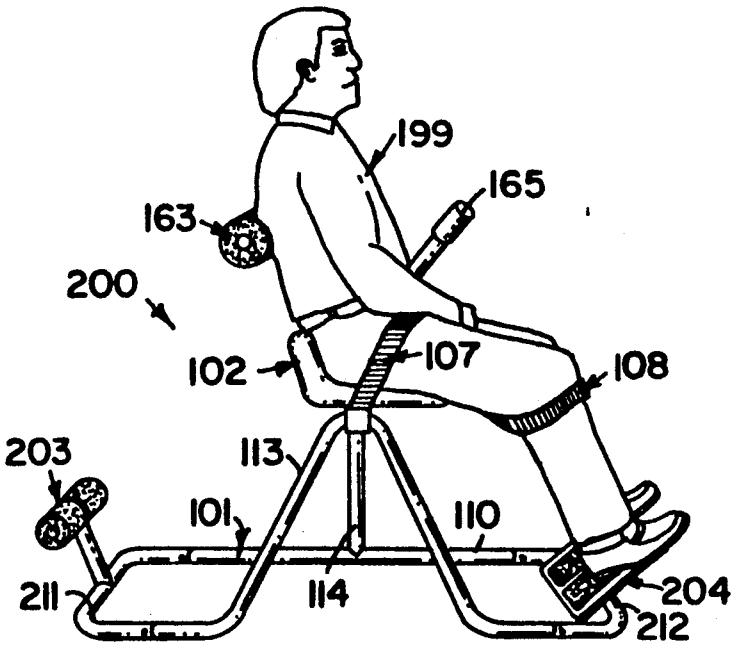
FIG. 16*a* is a front view of the alternative embodiment exercise apparatus shown in FIGS. 8-14, in a second configuration with a person using the apparatus to perform lower back flexions.
Figure 16B:
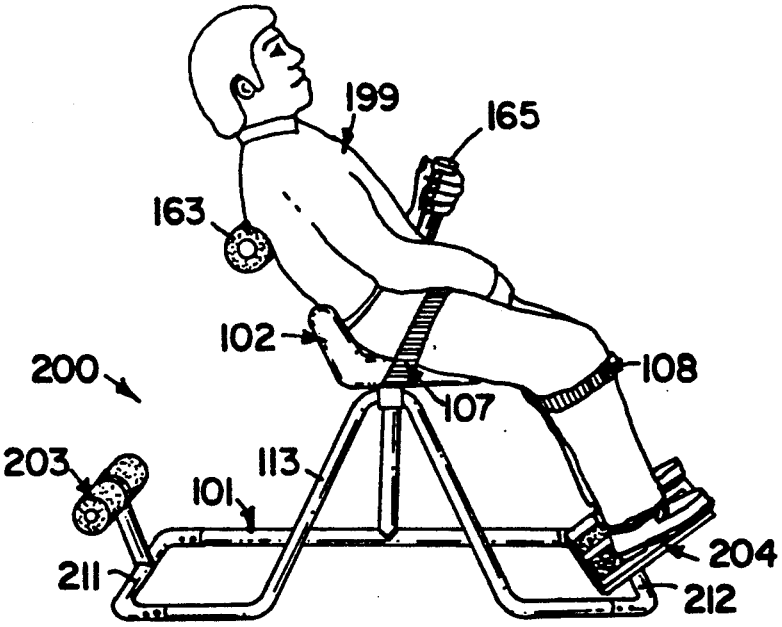
FIG. 16*b* is a front view of the alternative embodiment exercise apparatus shown in FIG. 16*a*, with the person using a support handle to return to an upright, seated position.

Referring to FIG. 16*a*, when the chair member 102 is rotated to a second orientation facing toward the foot brace means 204 (or 104 in the preferred embodiment), the apparatus is in a second configuration suitable for lower back flexions. As above, the person 199 sits on the chair member 102 and secures the pelvis stabilization means 107 about his waist and the thigh stabilization means 108 about his legs. The person 199 then extends his legs, making any necessary adjustment to the thigh stabilization means 108 in the process, so that the bottoms of his feet are positioned squarely against the platform member 243. In the preferred embodiment, the bottoms of the person's feet would be positioned squarely against the lateral member 143. In this position, the person 199 will notice the orbital member 162 extending behind his back. The person 199 leans backward against the orbital member 162, and with his feet braced against the foot brace means 204, the person 199 flexes his lower back muscles to arch backward and rotate the rotational arm means 106 against the resistance of the rotational resistance means 105. The direction of rotation is the same as that for abdominal flexions because the chair has been rotated 180 degrees relative to the rotational resistance means 105 and the rotational arm means 106. Again, where some type of return mechanism is provided, the person 199 simply returns to an upright seated position upon completion of the backward arch, and the rotational arm means 106 follows. Otherwise, the person 199 either retains the orbital member 162 with one or both of his arms as he returns to an upright seated position, or after returning to his starting position, the person 199 pushes on the handle member 165 to return the rotational arm means 106 to its starting position. Referring to FIG. 16*b*, the support member 164 may serve a second important function in connection with back flexion exercises, because it may become necessary for the person 199 to grip the handle member 165 and pull himself up relative to the support member 164 in order to return to an upright seated position.

The same alignment of rotational axes of the rotational resistance means 105, the rotational arm means 106, and the hips of the person 199 is again realized due to the relative positioning of the chair member 102 at the first elevation and the rotational resistance means 105 at the fourth elevation. Similarly, the relative positioning of the chair member 102 at the first elevation and the foot brace means 204 at the alternative third elevation, as well as the overall distance therebetween, is also calculated to accommodate persons of average size and within a range of such average size. Furthermore, the ends of the second end member 212 slidably engage their counterparts on the remainder of the base member 110, and series of mating holes are provided for bolts 119*b*, so that the distance between the foot brace means 204 and the chair member 102 can also be adjusted to accommodate persons of various sizes.

Figure 18:
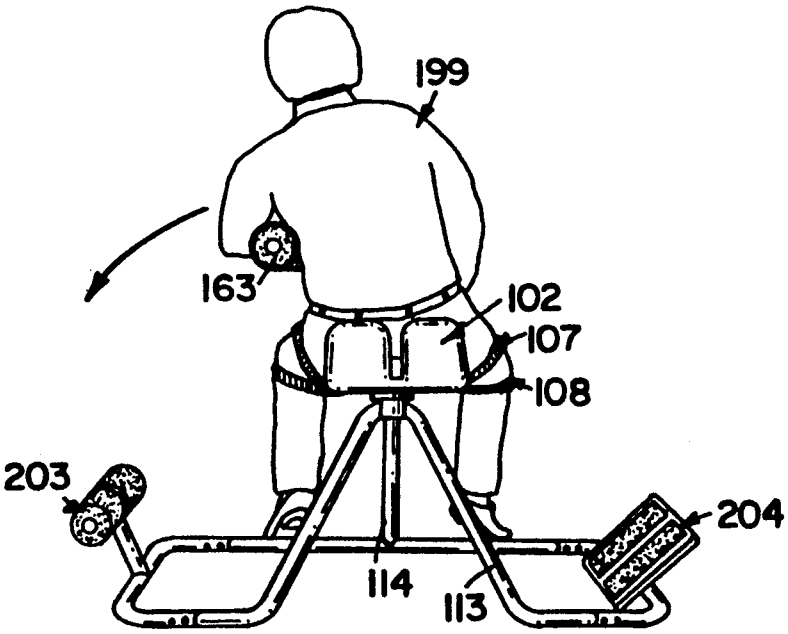
FIG. 18 is a front view of the alternative embodiment exercise apparatus shown in FIGS. 8-14, in a fourth configuration with a person using the apparatus to perform left side flexions.
Figure 17:
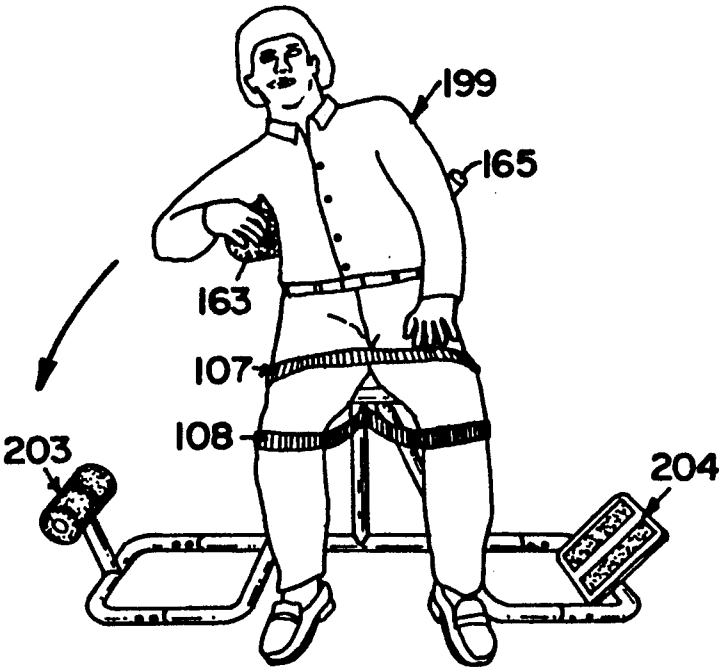
FIG. 17 is a front view of the alternative embodiment exercise apparatus shown in FIGS. 8-14, in a third configuration with a person using the apparatus to perform right side flexions.
Figure 20:
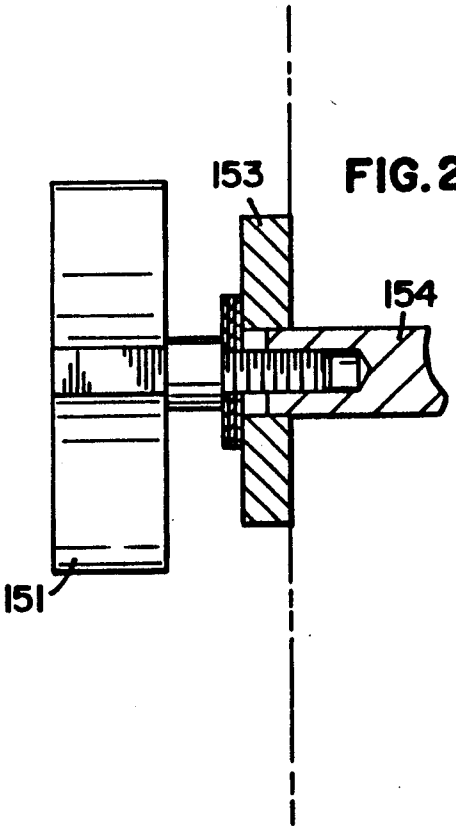
FIG. 20 is an enlarged left side view of the adjustment knob and shaft member comprising a part of the rotational resistance means shown in FIG. 19.
Figure 19:
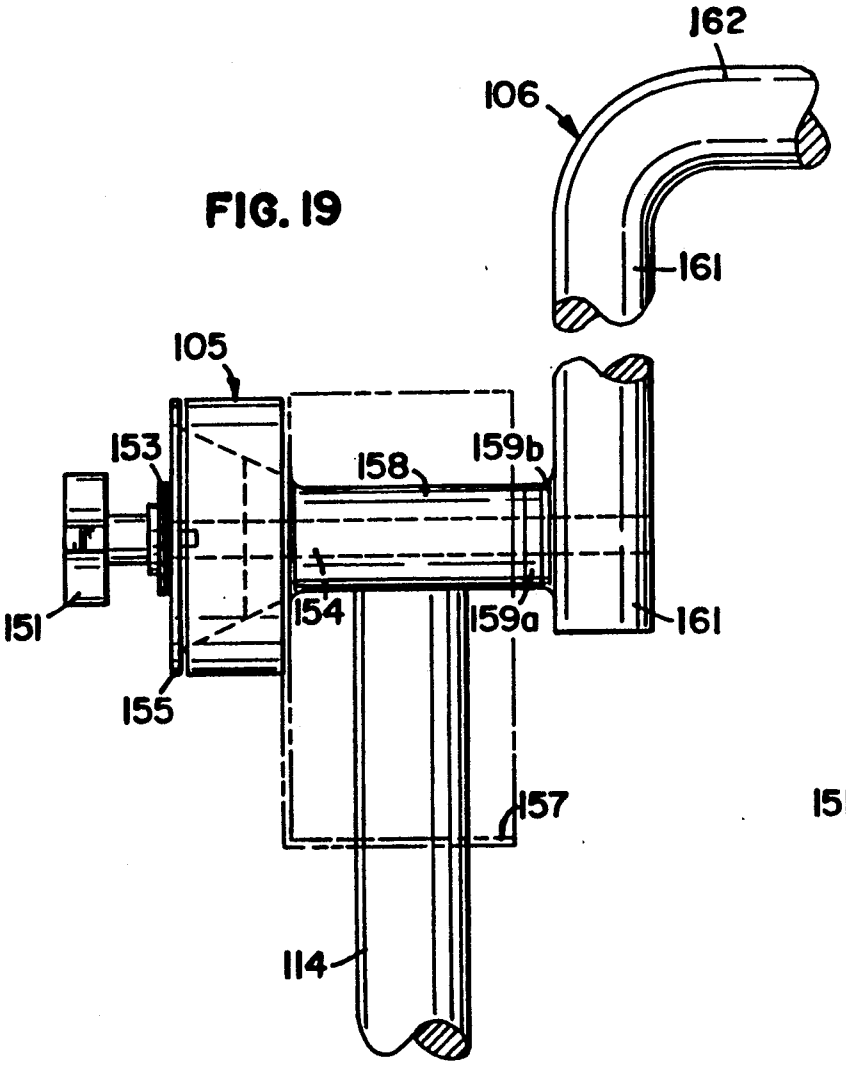
FIG. 19 is an enlarged left side view of the rotational resistance means comprising a part of the exercise apparatus shown in FIGS. 1-18.

Referring to FIG. 17, when the chair member 102 is rotated to a third orientation facing forward, away from the rotational resistance means 105, the apparatus 100 is in a third configuration suitable for right side flexions. When seated in this orientation, the person 199 will notice the orbital member 162 extending proximate his right side. Similarly, referring to FIG. 18, when the chair member 102 is rotated to a fourth orientation facing rearward, toward the rotational resistance means 105, the apparatus 100 is in a fourth configuration suitable for left side flexions. When seated in this orientation, the person 199 will notice the orbital member 162 extending proximate his left side. In each case, resistance is provided against rotation of the rotational arm means 106 in the same direction, because it is the rotation of the chair member 102 relative to the rotational resistance means 105 and the rotational arm means 106 that defines the various configurations of the apparatus 100. In each case, the side flexion exercises are performed in a fashion similar to that described above for abdominal and lower back flexions, but with the persons feet supported against the floor surface 109. The present invention provides a relatively compact and inexpensive apparatus that facilitates reliable exercise of the abdominal, lower back, and lateral oblique muscle groups. While the present invention has been described in terms of two particular embodiments, those skilled in the art will recognize the applicability of various modifications and alternative embodiments. Accordingly, the scope of the present invention is to be limited only by the appended claims.

What is claimed is:

1. An apparatus of a type on which a person exercises, comprising:

(a) a support frame designed to rest upon a floor surface;

(b) a chair member, rotatably mounted to said support frame, wherein said chair member defines an axis of rotation substantially perpendicular to the floor surface, and said chair member includes a seat member designed to support the posterior of a person sitting in said chair member and a back member designed to support the lower back of a person sitting in said chair member, and wherein the person sits in said chair member to exercise on the apparatus;

(c) a rotational resistance means, operatively connected to said support frame, for providing resistance to rotation in a given direction up to a given load;

(d) a rotational arm means, operatively connected to said rotational resistance means, for receiving a rotational force in the given direction from the person seated in said chair member , wherein said rotational resistance means defines an axis of rotation substantially parallel to the floor surface and co-planar with said axis of rotation defined by said chair member;

(e) a floor anchor means, mounted to said support frame, for providing a support behind which the person seated in said chair member may anchor his feet while performing abdominal flexions; and (f) a foot brace means, mounted to said support frame, for providing a support against which the person seated in said chair member may brace his feet while performing lower back flexions.

2. An apparatus according to claim 1, wherein said support frame has a first end and a second end, and said foot anchor means is mounted to said support frame proximate said first end, and said foot brace means is mounted to said support frame proximate said second end, and said chair member is rotatable between a first orientation, facing said first end and said foot anchor means, and a second orientation, facing said second end and said foot brace means, and when said chair member is in said first orientation, the apparatus is in a first configuration suitable for abdominal flexions, and when said chair member is in said second orientation, the apparatus is in a second configuration suitable for lower back flexions.

3. An apparatus according to claim 2, wherein said rotational arm means includes a radial member and an orbital member, and said orbital member extends perpendicularly from said radial member and in a direction perpendicular to a plane of rotation defined by said rotational resistance means and toward said chair member.

4. An apparatus according to claim 3, wherein said rotational arm means further includes a support member extending perpendicularly from said radical member and in a direction parallel to the plane of rotation, wherein a person performing lower back flexions pushes backward against said orbital member to move said rotational arm means in a first direction, and the person pushes forward against said support member to move said rotational arm means in a second, opposite direction.

5. An apparatus according to claim 3, wherein when said chair member is in said first orientation, said orbital member occupies an unloaded position in front of the person seated in said chair member, and when said chair member is in said second orientation, said orbital member occupies an unloaded position to the right side of the person seated in said chair member, and said chair member is rotatable to a fourth orientation where said orbital member occupies an unloaded position to the left side of the person seated in said chair member, and when said chair member is in said third orientation, the apparatus is in a third configuration suitable for right side flexions, and when said chair member is in said fourth orientation, the apparatus is in a fourth configuration suitable for left side flexions.

6. An apparatus according to claim 1, further comprising a pelvis stabilization means, operatively connected to said chair member, for stabilizing the pelvis of the person seated in said chair member relative to said chair member.

7. An apparatus according to claim 1, further comprising a thigh stabilization means, operatively connected to said chair member, for stabilizing the thighs of the person seated in said chair member relative to said chair member.

8. An apparatus according to claim 1, wherein said rotational resistance means provides passive, frictional resistance to rotation of said rotational arm means.

9. An apparatus of a type on which a person exercises, comprising:

(a) a support frame designed to rest upon a substantially horizontal surface, wherein said support frame includes a first end and a second end;

(b) a chair member rotatably mounted to said support frame between said first end and said second end, wherein said chair member is rotatable between a first orientation, facing in a substantially horizontal direction toward said first end, and a second orientation, facing in a substantially horizontal direction toward said second end, and wherein said chair member includes a seat member and a back member that define an oblique angle therebetween, and said back member includes a pair of wing members defining an elongate vertical slot therebetween;

(c) a first transverse member, mounted to said support frame proximate said first end and designed to provide a support behind which a person seated in said chair member may anchor his feet;

(d) a second transverse member, mounted to said support frame proximate said second end and designed to provide a support against which a person seated in said chair member may brace his feet;

(e) a rotational resistance means, operatively connected to said support frame between said first end and said second end, for providing resistance to rotation in a given direction up to a given load; and (f) a rotational arm means, operatively connected to said rotational resistance means, for receiving a rotational force in the given direction from a person seated in said chair member.

10. An apparatus according to claim 9, wherein said chair member is rotatable to a third orientation intermediate said first orientation and said second orientation and facing in a substantially horizontal direction away from said rotational resistance means, and said chair member is rotatable to a fourth orientation intermediate said first orientation and said second orientation and facing in a substantially horizontal direction toward said rotational resistance means.

11. An apparatus according to claim 9, further comprising pelvis stabilization means, operatively connected to said chair member, for stabilizing the pelvis of a person seated in said chair member.

12. An apparatus according to claim 11, wherein said pelvis stabilization means includes a belt member having a portion of said belt member secured beneath the platform of said seat member, wherein said belt member is designed to secure abut the waist of a person seated in said chair member.

13. An apparatus according to claim 9, further comprising thigh stabilization means, operatively connected to said chair member, for stabilizing the pelvis of a person seated in said chair member.

14. An apparatus according to claim 9, wherein said rotational arm means includes a radial member, an orbital member, and a support member, and said radial member extends from said rotational resistance means, radially relative to the given direction of said rotational resistance means, and said support member extends perpendicularly from said radial member, and tangentially relative to the given direction of rotation of said rotational resistance means, and said orbital member extends perpendicularly from said radial member, and perpendicular relative to said support member, and said support member is nearer said rotational resistance means than in said orbital member.

15. An exercise apparatus comprising:

(a) a support frame designed to rest upon a substantially horizontal surface;

(b) a chair member mounted to said support frame;

(c) a rotational arm means, rotatably mounted relative to said frame for receiving a rotational force in a given direction from a person seated in said chair member; and (d) a rotational resistance means operatively connected to said rotational arm means, for providing resistance to rotation of said rotational arm means in the given direction up to a given load, wherein said rotational resistance means includes (i) a fixed friction member rigidly secured to said support frame and having a conical internal surface; (ii) a rotatable friction member having a conical external surface in contact with said conical internal surface of said fixed friction member, wherein rotation of said rotatable friction member relative to said fixed friction member is resisted by a frictional force between said conical external surface and said conical internal surface; (iii) a shaft member coaxially aligned relative to said fixed friction member and said rotatable friction member, and passing rough centrally located openings therein, wherein said shaft member has a first end and a second end, and said first end is rigidly secured to said rotational arm means, and a portion of said shaft member passing through said rotatable friction member has teeth about its circumference, and upon rotation of said shaft member in a first shaft direction, one of said teeth engages one of a plurality of ratcheting member pivotally mounted on said rotatable friction member, thereby causing said rotatable friction member to rotation in conjunction with said shaft member and relative to said fixed friction member, and upon rotation of said shaft member in a second shaft direction, opposite said first shaft direction, said ratcheting members pass over said teeth, and said shaft member rotates relative to said rotatable friction member and said fixed friction member; and (iv) a frictional force adjustment knob secured relative to said second end of said shaft member by interengaging threads on said knob and said second end, wherein rotation of said knob in a first knob direction relative to said shaft member increases the frictional force between said conical internal surface and said conical external surface, and rotation of said knob in a second knob direction relative to said shaft member, opposite said first knob direction, decreases the frictional force between said conical internal surface and said conical external surface.

* * * * *